United States Patent [19]

Kang et al.

[11] Patent Number: 4,642,998

[45] Date of Patent: Feb. 17, 1987

[54] REFRIGERATOR COOLING AIR FLOW CONTROL APPARATUS

[75] Inventors: Yun H. Kang; Wha S. Im; Kil S. Lee, all of Kyunggi-do, Rep. of Korea

[73] Assignee: Samsung Electronic Co., Ltd., Ky Inggi-Do, Rep. of Korea

[21] Appl. No.: 773,062

[22] Filed: Sep. 6, 1985

[51] Int. Cl.[4] ..... F25D 17/04

[52] U.S. Cl. ..... 62/187; 62/408; 62/441

[58] Field of Search ..... 62/187, 407, 408, 441

[56] References Cited

U.S. PATENT DOCUMENTS 2,660,036 11/1953 Moore ..... 62/408 X 3,093,981 6/1963 O'Grady ..... 62/408

3,373,576 3/1968 Dodge, III et al. ..... 62/408 X

*Primary Examiner*—Lloyd L. King

*Attorney, Agent, or Firm*—Barnes & Thornburg

[57] ABSTRACT

The present invention is related to a switching device for selectively controlling the flow of cooling air in a central cooling air duct of a refrigerator of the type having a cold storage space and a freezing storage space. In preferred embodiments, the switching apparatus includes a pivotal flap member disposed in a cooling air duct leading to both the freezing and cold storage spaces. A manually operable control lever is pivotably mounted at a housing attached to the cooling air duct and is interconnected to pivot the control flap valve by means of a connecting pin having one end connected to the control lever and the other end connected to a working lever which is in rotatably fixed with the pivot axis of the control flap.

6 Claims, 4 Drawing Figures

REFRIGERATOR COOLING AIR FLOW CONTROL APPARATUS

BACKGROUND AND SUMMARY OF THE INVENTION

The present invention relates to improvements in refrigerators of the type having separate cold storage and freezing storage spaces. More particularly, the present invention is directed to an improved control apparatus for accommodating selective operation of the refrigerator only for cold storage, with the effective cold storage space enlarged by the normal freezing storage space.

In conventional refrigerators, the freezing storage space is separated from the cold storage space. However the two storage spaces are mechanically operably interconnected in that they are operated by a single cooling device. In such refrigerators, when one wishes to use the cold storage space only, both spaces are effectively operated upon by the cooling air so that the freezing storage space is operated at freezing temperatures along with the operation of the cold storage space above freezing temperatures. By freezing temperatures, this disclosure intends to mean the freezing temperature of water. Thus, even when there is no food to be placed in the freezing storage space or in the event the freezing storage space is not needed during certain seasons, such as in the winter, the freezing storage space is still operated in conjuction with the use of the cold storage space, entailing a wasteful use of electricity.

The present invention contemplates overcoming the above-described difficulties with conventional refrigerators by providing an arrangement for selectively operating the freezing storage space in such a refrigerator as an extension or enlargement of the cold storage space by appropriate control of the cooling air flow to the two spaces. In especially preferred embodiments, a central cooling air duct of the refrigerator, which normally communicates with both the cold storage space and the freezing storage space, is provided with a movable control valve which can be selectively moved so as to control the amount of cooling air flow into the freezing storage space. In particularly preferred embodiments, the control valve member is pivotably mounted and is attached at one end or side to pivot along with a working lever. The working lever is interconnected to a manually operable switching lever so that it can be selectively pivotably moved to effectively rotate and pivot the control valve between an air duct open position for a normal refrigerator operation and a cold storage only refrigerator operation with the control valve limiting the flow of cooling air to the freezing storage space so that it then operates as an extension or enlargement of the cold storage space.

According to especially preferred embodiments, the control valve is constructed as a flat valve member having a pivot axis along one side thereof, which pivot axis is defined by a projecting key engageable into an opening at the cooling duct wall and a bearing opening which is engageable in turn with a shaft key which is rotated by the manually operated lever mechanism. The shaft key in turn is rotatably connected with a working lever, which working lever has its opposite end rotatably or pivotably connected to an I-type connecting pin. The other end of the connecting pin is pivotably connected at one arm of the manually operable control lever, the other arm being engageable by the person operating the same such that pivotable movement of the control lever selectively lifts or lowers the connecting pin, which in turn pivotably moves the working lever to rotate the shaft key for pivoting the control flap valve. In especially preferred embodiments, a biasing spring is provided for assisting in the pivot movement of the lever mechanism for operating the control flap valve. The biasing spring and the pivot mount for the control lever are disposed in a lateral housing attached at one side of the central air duct and include an abutment for the biasing spring.

Further objects, features, and advantages of the present invention will become more apparent from the following description when taken with the accompanying drawings which show, for purposes of illustration only, an embodiment in accordance with the present invention.

DETAILED DESCRIPTION OF THE DRAWINGS

Figure 1:
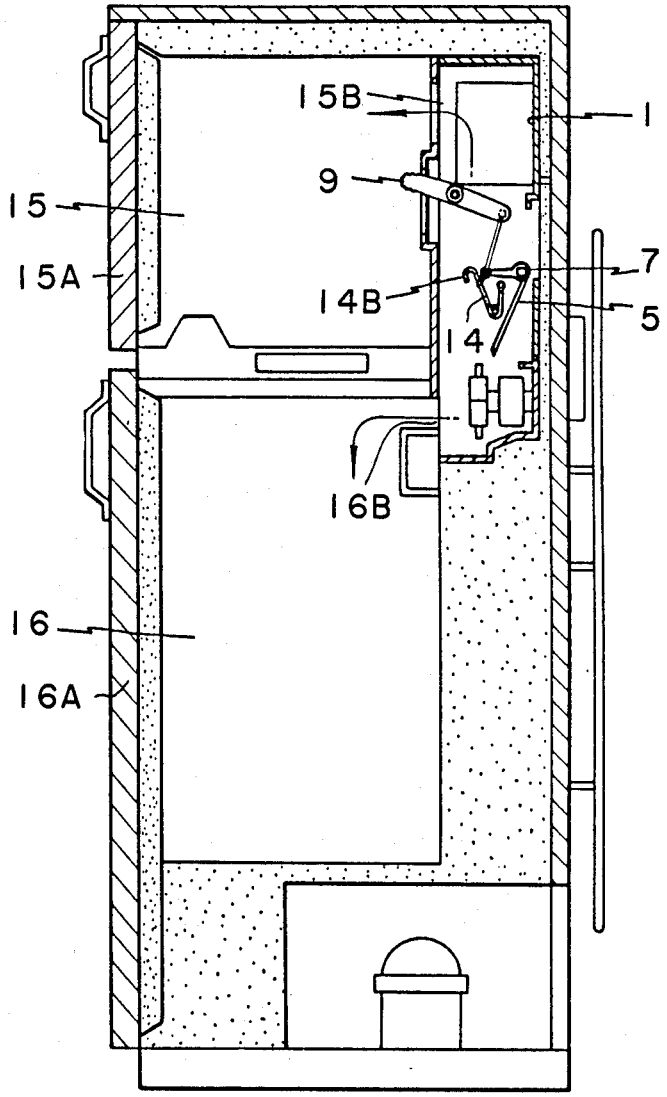
FIG. 1 a sectional schematic side view of a refrigerator having a cooling air flow control apparatus constructed in accordance with a preferred embodiment of the present invention.
Figure 2:
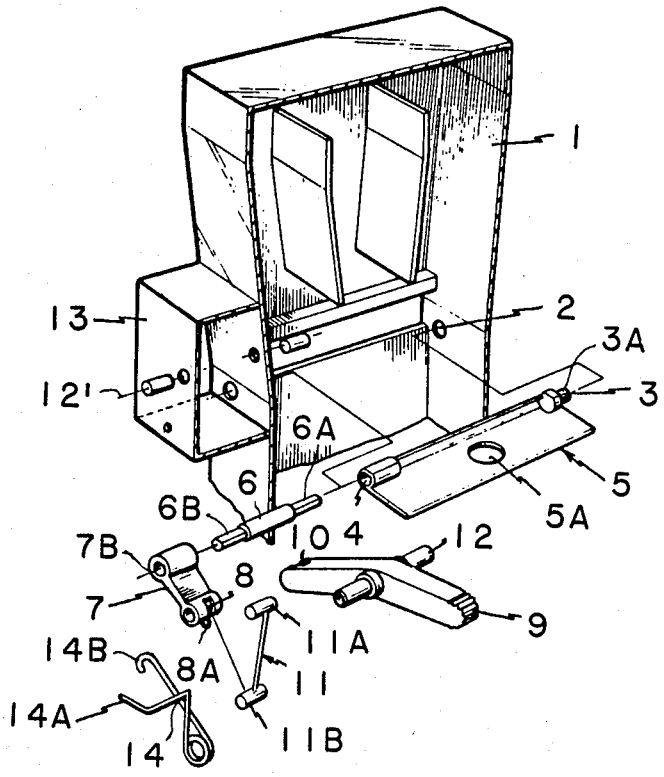
FIG. 2 is a schematic enlarged perspective exploded view showing the cooling air flow control apparatus for the refrigerator of FIG. 1.
Figure 3:
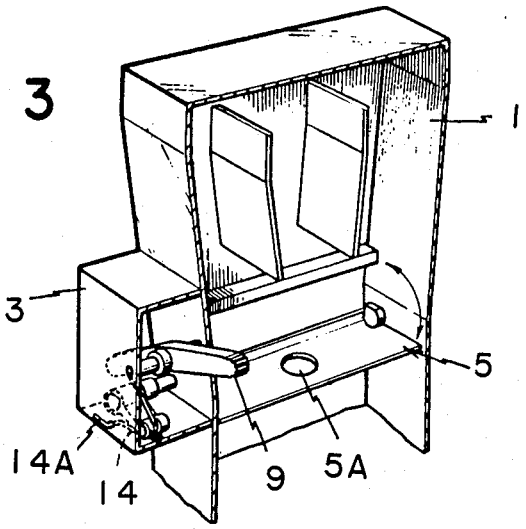
FIG. 3 is a view similar to FIG. 2, but showing the parts of the cooling air flow control apparatus in their installed condition.
Figure 4:
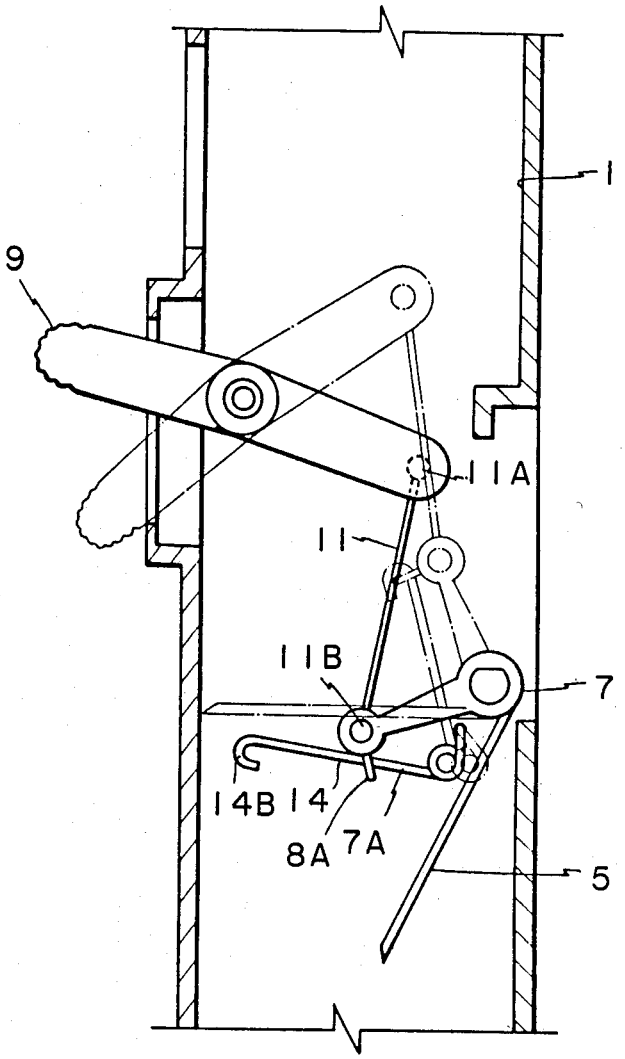
FIG. 4 is a schematic enlarged side view depicting the operational movement of the parts of the cooling air flow control apparatus of the embodiments of FIGS. 1–3.

FIG. 1 schematically depicts a refrigerator having a freezing storage space 15 accessible by a freezing space door 15A and a cooling storage space 16 accessible via cooling space door 16A. A central cooling air duct 1 is provided for communicating cooling air to the respective storage spaces 15 and 16 via opening 15B and 16B. In order to control the flow of cooling air in this cooling air duct 1, and thereby to optionally operate the freezing storage space 15 as a cooling storage space, a control valve assembly, best illustrated in FIGS. 2–4, is provided in the cooling air duct 1.

The control member is a flap member 5 which includes a projecting piece 3 having a key projection 3A at one lateral side thereof and a control flap bearing opening 4 opposite the key projection 3A, which opening 4 and key projection 3A define a pivot axis for the flap member 5. Laterally of the air duct 1, a housing 13 is provided for accommodating the control lever mechanism for the flap member 5, described further below.

The control flap member 5 is maintained in position by means of the bearing opening 2 engaging with the key projection 3A and the shaft 6 engaging, with end part 6A, through opening 13A and into bearing opening 4 of the control flap. The opposite end 6B of the shaft 6 is rotatably fixed to a bearing opening 7B in a working lever 7. Thus the shaft 6 rotatably fixes the flap member 5 with the working lever 7 so that pivotable movement of the lever 7 results in rotational or pivotable movement of the flap member 5 about the axis defined by opening 4 and key projection 3A.

Working lever 7 includes a rotary pin groove 8 at the end opposite the opening 7B for accommodating one end portion 11*b* of an I-type rotory connecting pin 11. The opposite end 11*a* of the connecting pin 11 is engageable in a corresponding rotary pin groove 10 provided at a control lever 9. Control lever 9 is pivotably borne in the side walls of the housing 13 and the duct 1 for pivotable movement about an axis 12' (see bearing part 12 in the exploded view of FIG. 2 for the control lever 9, which will be aligned with the schematically depicted pivot axis 12' in the assembled condition as shown in FIG. 3). A biasing spring 14 is provided which is interposed between the working lever 7 and the housing 13, including an abutment portion 14A engageable against the housing 13.

The control flap member 5 further includes an opening 5*a* for permitting a flow of a small amount of cooling air therethrough during conditions when the flap member 5 is closed and the refrigerator is operating in a cold storage mode for both cold storage space 16 and the normally freezing storage space 15.

As can be seen from FIGS. 2 and 3, the assembly of the control apparatus of the present invention is simple and economical. The control valve flap member 5 is inserted with the key projection 3A in the bearing opening 2 at the side wall of the duct 1 and with the shaft 6 inserted through opening 13A and projection 6A rotatably fixed in the bearing opening 4 of the flap 5 and the other end 6B inserted in the opening 7B of the working lever 7 so as to also be rotatably keyed therewith. The control lever 9 is pivotably supported at axis 12, 12' by means of schematically depicted bearing pins extending in the respective side walls of duct 1 and the housing 13. The I-type connecting pin 11 interconnects with pin groove 8 at the working lever 7 and pin groove 10 at the control lever 9. The spring 14 is interposed in the assembly with abutment portion 14A engageable at a corresponding corner section of the housing 13 and the opposite end biasingly engageable with the working lever 7.

In operation when in an installed condition on a refrigerator (see FIGS. 1 and 4), the air control apparatus assembly of the present invention operates as follows.

When the lever 9 is pressed downwardly, the upper end 11A of the I-type rotory pin 11 attached to the pin groove 10 of lever 9 is pulled upwardly and at the same time the lower end 11*b* of the pin 11 connected via pin groove 8 to the working lever 7 is pulled upwards. Thus as the rotory pin 11 is pulled upwards, the shaft 6 is rotated via the pivotable movement of working lever 7, thereby stretching the spring 7*a* caught between the working lever and the supporting housing 13. As the spring 7*a* is stretched to some extent, the working lever 7 will easily move upwardly and the control valve 5 will rotate and block up the boundary between the freezing storage space 15 and the cold storage space 16 as it moves into a level or horizontal position in the duct 1. Thus, cool air flows only through the circulating hole 5*a* and the freezing storage space 15 can then be useable as an extension or enlargement of the cold storage space 16. At this time, the projection 3A of the projection piece 3 is forceably fixed into the bearing hole 2 by the pressing motion of the lever 9 and the lever 9 is held in place as it is pressed down.

Thus the refrigerator is switched to an only cold storage operation with the manually operable lever 9 in the downward position with closing of the flap member 5 at the air duct 1.

When it is desired to return the refrigerator to a normal operation with freezing in the freezing storage space 15 and normal cooling in the cooling storage space 16, the lever 9 is raised, with a consequent downward pushing of the I-type rotory pin 11 and the consequent pushing downward of the rotory pin groove 8 end of the working lever 7. Thus working lever 7 also moves downwardly and the spring 14 interposed between working lever 7 and supporting housing 13 comes back to its original position. In this position, the control valve 5 is moved to its open position thus accommodating the separate use of the freezing storage space 15 and the cold storage space 16. Spring 14 engages with hook portion 14B through hook portion 8A provided at the end of lever 7 so that the spring can abuttingly act on lever 7 and slide axially as depicted in FIG. 4 as the lever assembly moves between the two end positions.

The present invention provides in a simple manner for the effective switching of the freezing storage space to a cold storage mode of operation for convenient use of the entire refrigerator, with the simple expediant of moving the control lever 9 and the consequent rapid motion of the rotary connecting pin 11 and the bearing connection of the projection piece 3A and bearing opening 4.

The preferred embodiment of the present invention also provides for a fixing of the control valve into the side walls of the cooling air duct via the projection piece 3A and the bearing connection opening 4 and the simple assembly of the driving rotary shaft 6, the working lever 7, connecting pin 11 and manually operable control lever 9, thereby making it easy and convenient to operate the control valve assembly.

The present invention exhibits advantages in that, via simply constructed and operated mechanism, the refrigerator can be selectively utilized for normal operation, as well as for cold storage only operation.

Although the present invention has been described and illustrated in detail, it is to be clearly understood that the same is by way of illustration and example only, and is net to be taken by way of limitation. The spirit and scope of the present invention are to be limited only by the terms of the appended claims.

What is claimed:

1. Switching apparatus for selectively controlling the flow of cooling air in a central cooling air duct of a refrigerator of the type having a cold storage space and a freezing storage space, said switching apparatus comprising:

control valve means movably mounted in the central cooling air duct, and manually operable control valve actuating means for moving the control valve means between a normal refrigerator operating position with cooling air flow to the freezing storage space to accommodate freezing therein and cooling air flow to the cold storage space to accommodate nonfreezing cooling therein and a cold storage operating position with cooling air flow to both the freezing storage space and cold storage space to accommodate nonfreezing cooling in both storage spaces so that said freezing storage space serves as an extension of the cold storage space, wherein the control valve means is a control flag valve which is disposed to open the central cooling air duct when in the normal refrigerator operating condition and to substantially close the central cooling air duct when in the cold storage operating position, and wherein said control flag valve is pivotally mounted at the cooling air duct, and wherein said control flap valve is constructed as a flat member having a bearing key projection extending laterally outward at one side thereof for engagement in a cooling air duct bearing opening and a control flap bearing opening at the opposite side thereof for accommodating the insertion of a drive shaft key of the control valve actuating means.

2. Apparatus according to claim 1, wherein said control flap valve includes an opening therethrough for accommodating a small amount of cooling air flow therethrough when in the closed cold storage operating position.

3. Apparatus according to claim 1, wherein said control valve actuating means includes a working lever, an I-type connecting pin, and a manually operable control lever, said working lever having one end portion rotatably keyed to the drive shaft key and the other end portion connected to one end of the connecting pin, the other end of the connecting pin being connected to one arm of the control lever, whereby manual actuation of the other arm of the control lever effects pivoting of the control flap valve via the connecting pin and working lever.

4. Apparatus according to claim 3, wherein spring means are provided for applying spring forces between the working lever and relatively fixed abutment means.

5. Apparatus according to claim 3, wherein the control lever is pivotally mounted at a control lever pivot axis which is spaced from the pivot axis for the control flap valve.

6. Apparatus according to claim 5, wherein said I-type connecting pin is connected at the working lever and the control lever via respective rotory pin grooves permitting relative pivotal movement of the connecting pin and these levers.

* * * * *